US005758368A

United States Patent [19]

Ball

[11] Patent Number: 5,758,368

[45] Date of Patent: Jun. 2, 1998

[54] WASTE WATER VALVES FOR BATHTUBS AND THE LIKE

[75] Inventor: William T. Ball, Leawood, Kans.

[73] Assignee: WCM Industries, Inc., Colorado Springs, Colo.

[21] Appl. No.: 859,847

[22] Filed: May 21, 1997

[51] Int. Cl.[6] ..... A47K 1/14

[52] U.S. Cl. ..... 4/295; 4/293

[58] Field of Search ..... 4/286, 287, 293–295, 4/290, 291, 679, 682, 688; 138/89

[56] References Cited

U.S. PATENT DOCUMENTS

| | | | |
|---|---|---|---|
| 1,760,659 | 5/1930 | Passman | 4/287 |
| 2,197,083 | 4/1940 | Schaible | 4/287 |
| 2,662,230 | 12/1953 | Borman | 4/287 |
| 2,915,762 | 12/1959 | Kivela | 4/295 |
| 3,366,980 | 2/1968 | Petursson et al. | 4/295 |
| 3,428,295 | 2/1969 | Downey et al. | 4/295 |
| 4,007,500 | 2/1977 | Thompson et al. | 4/295 |
| 4,339,832 | 7/1982 | Cischera | 4/295 |
| 4,369,531 | 1/1983 | Swanson | 4/295 |
| 4,420,844 | 12/1983 | Puckett et al. | 4/295 |
| 4,720,877 | 1/1988 | Watts | 4/286 |
| 4,926,507 | 5/1990 | Craig et al. | 4/286 |
| 5,072,461 | 12/1991 | Logsdon | 4/286 |

*Primary Examiner*—Charles R. Eloshway
*Attorney, Agent, or Firm*—Zarley, McKee, Thomte, Voorhees, & Sease

[57] ABSTRACT

A waste water valve for use in the bottom of a bathtub or the like has a drain insert extending through an opening in the bottom end of the receptacle. A support member extends across the lower end of the drain inset and the vertical post is secured thereto and extends outwardly therefrom. The post has a flat planar surface thereon which intersects with an annular groove adjacent the top of the post. A closure member with a central bore is rotatably mounted on the post and is rotatable with the post when lifted to a position within the annular groove. A washer is secured within the center bore of the closure member and has a circular center bore with a flat segment adjacent thereto to permit the closure member to dwell within the annular groove when the flat segment is out of alignment with the planar surface of the post, but which will permit the closure member to slidably turn relative to the post when the flat surface is in alignment with the planar surface.

4 Claims, 3 Drawing Sheets

WASTE WATER VALVES FOR BATHTUBS AND THE LIKE

BACKGROUND OF THE INVENTION

Waste water valves for tubs and the like often have components which permit the valve element to be lifted from a closed position, and then turned or rotated to cause the valve to be held in an elevated open position. However, these existing valves are expensive to manufacture.

It is therefore a principal objective of this invention to provide a "lift and turn" waste water valve which is economical of manufacture, and easily operated.

These and other objects will be apparent to those skilled in the art.

SUMMARY OF THE INVENTION

The waste water valve of this invention has a base member with a cylindrical drain insert having upper and lower ends. A horizontal flange extends around the upper end of the drain insert, and a horizontal support member extends across the drain insert adjacent its lower end. A vertical post having upper and lower ends with the lower ends secured to the center of the support member has an upper end terminating above the level of the horizontal flange on the drain insert.

A closure member has a central portion with a vertical central bore therein rotatably and slidably receiving the vertical post. A horizontal flange extends from the closure member and is positioned above and parallel to the horizontal flange on the drain insert. A cylindrical seal element is secured to the closure member below and adjacent to the horizontal flange on the closure member and is adapted to move into sealing contact with the horizontal flange on the drain insert when the closure member moves downwardly to its maximum lowest position on the post.

A hollow knob is removably secured to the closure member and extends upwardly therefrom to receive the upper end of the post. A circular annular groove is formed adjacent the upper end of the post, and a planar vertical surface on the post intersects the annular groove. A washer which has a center bore is loosely and rotatably mounted in the annular groove. The center bore of the washer is circular with a flat segment extending across one portion thereof so that the washer can slide on the post when the flat segment is aligned with the planar surface on the post. Thus, when the washer is in the annular groove, it will hold the closure member in an elevated position on the post when the closure member and the washer are turned to a position where the flat segment is disaligned with the planar surface on the post.

A BRIEF DESCRIPTION OF THE DRAWINGS

DESCRIPTION OF THE PREFERRED EMBODIMENT

Figure 1:
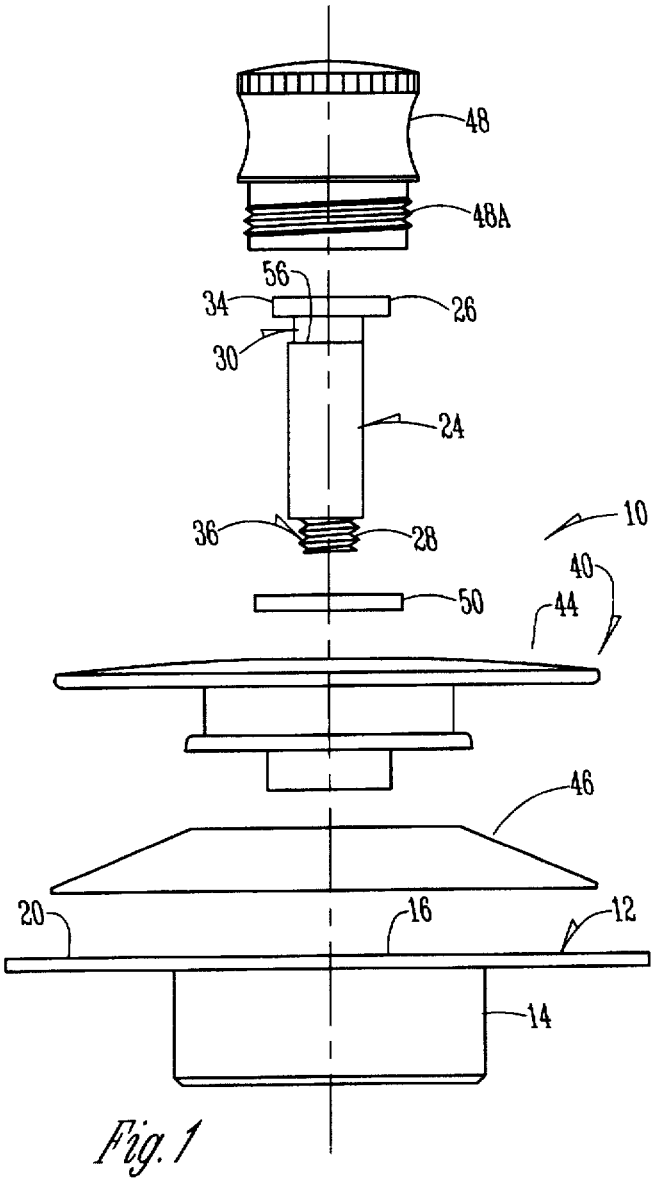
FIG. 1 is an exploded view of the waste water valve of this invention shown in elevational form.
Figure 2:
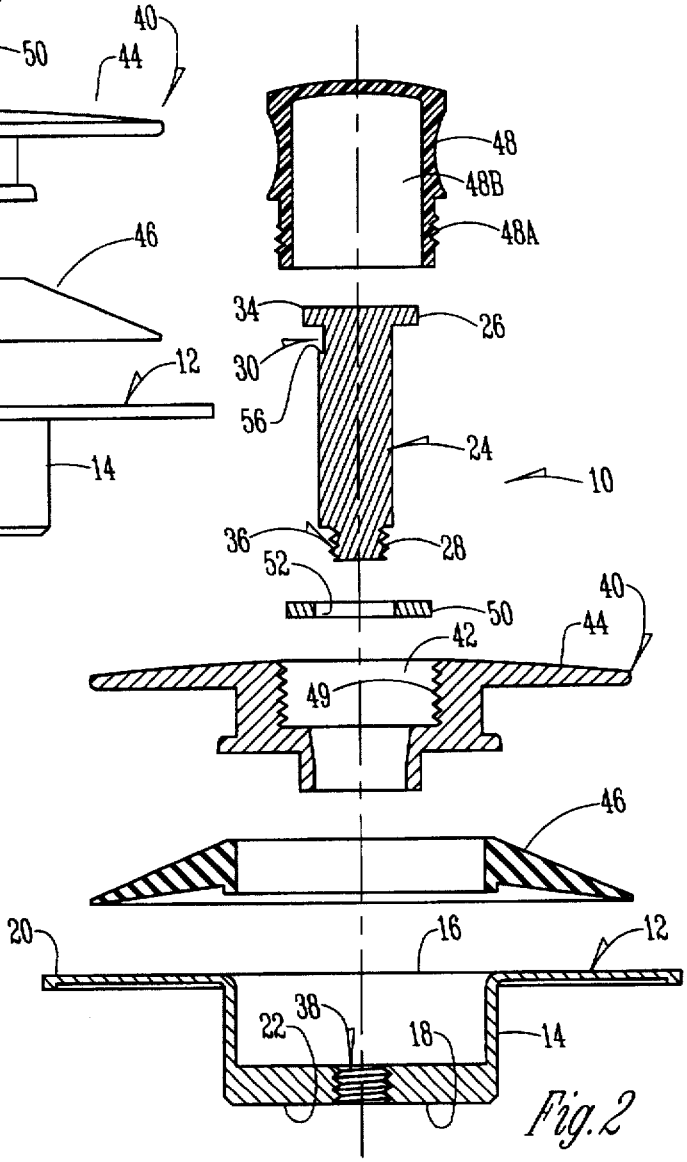
FIG. 2 is a view similar to that of FIG. 1 with the various components shown in sectional form.

The waste water valve 10 has a base member 12 which has a cylindrical drain insert 14 with an upper end 16 and a lower end 18. A horizontal flange 20 extends outwardly from the upper end of the drain insert 14 (FIGS. 1 and 2). An elongated narrow support member 22 extends across the lower end 18 of the drain insert 14. It should be understood that the lower end 18 is open and that the support member 22 does not close the lower end of the drain insert 14.

Figure 6:
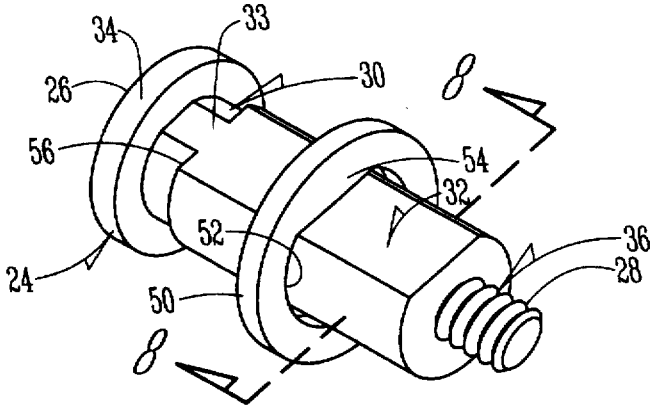
FIG. 6 is a view similar to that of FIG. 5 but shows the washer and post in the relative position shown in FIG. 4.
Figure 7:
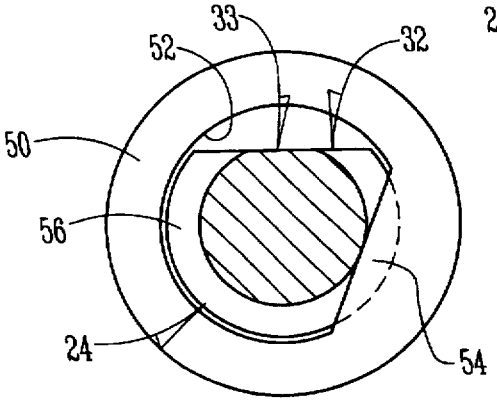
FIG. 7 is a sectional view taken on line 7—7 of FIG. 5.
Figure 8:
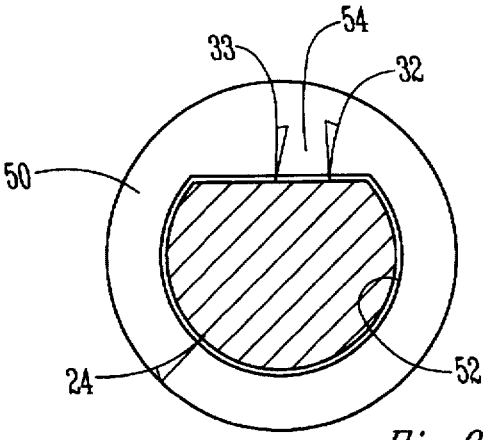
FIG. 8 is a sectional view taken on line 8—8 of FIG. 6.

A vertical post 24 has an upper end 26 and a lower end 28. An annular groove 30 (FIG. 6) extends substantially around the post 24 adjacent the upper end 26. A flat planar surface 32 is formed on one side portion of the post 24 and extends throughout the substantial length of the post. As best shown in FIG. 6, a portion 33 of the flat planar surface 32 extends across the annular groove 30. The upper end of post 24 terminates in a cap 34 which has a larger diameter than the post 24 or the annular groove 30. A threaded stud 36 extends concentrically downwardly from the bottom end 28 of post 24. Stud 36 is adapted to be received into the threaded aperture 38 in support member 22 (FIGS. 1–4).

A closure member 40 has a center bore 42 and a horizontal flange 44 extending outwardly therefrom. A cylindrical resilient seal element 46 is detachably secured to closure member 40 (FIGS. 1–4) and is positioned below the horizontal flange 44 and is adapted to seal against horizontal flange 20 of the base member 12 when the closure member is in its lowermost position. A hollow knob 48 has threads 48A on its lower end and is adapted to be threadably received in the threads 49 in the center of bore 42. Space 48B in knob 48 has a vertical height sufficient to receive the upper end of post 24 when closure member 40 drops downwardly so that seal element 46 engages flange 20 of base member 12.

A washer 50 (FIGS. 5–8) has a center bore 52 with a flat segment 54 extending across one side portion thereof so that the bore 50 is not completely circular. The washer 50 is held in place within the center bore 42 of closure member 40 by the knob 48 (FIGS. 3 and 4).

Figure 3:
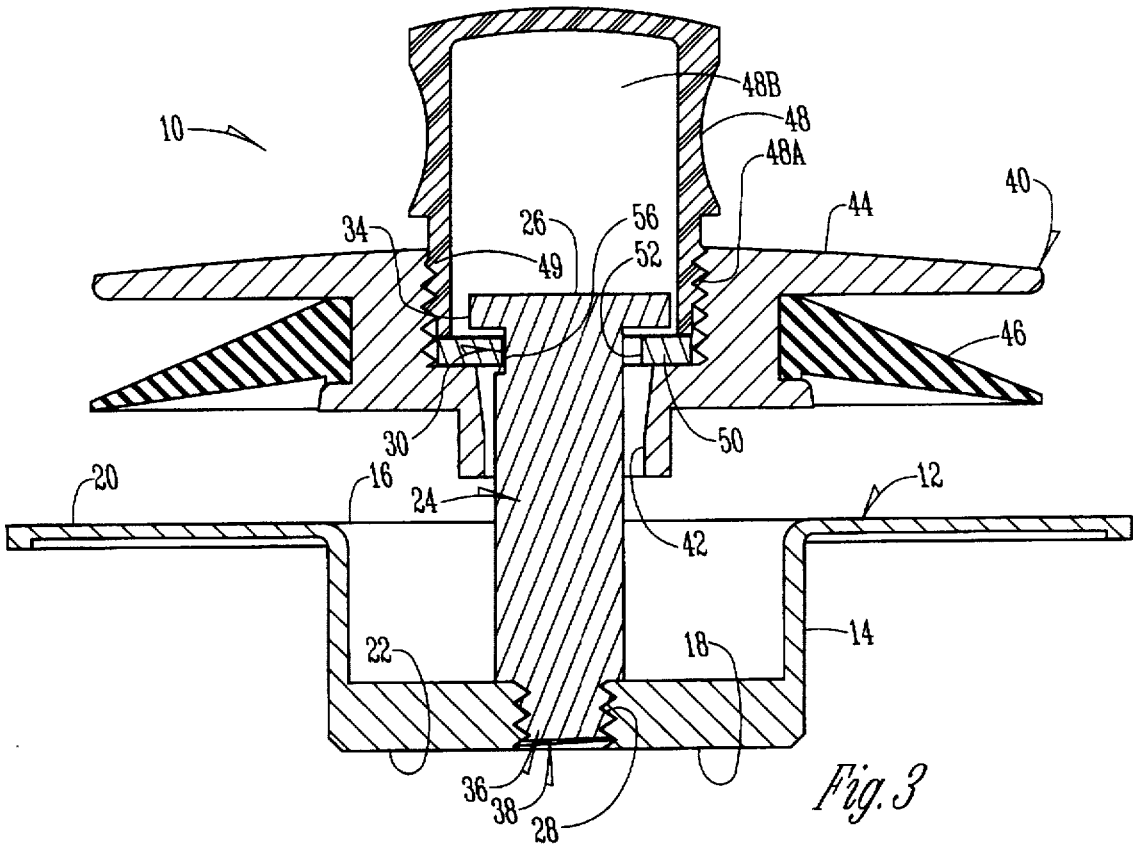
FIG. 3 is an enlarged scale sectional view of the assembled components of FIG. 2 with the closure member being held in its elevated or open position.
Figure 4:
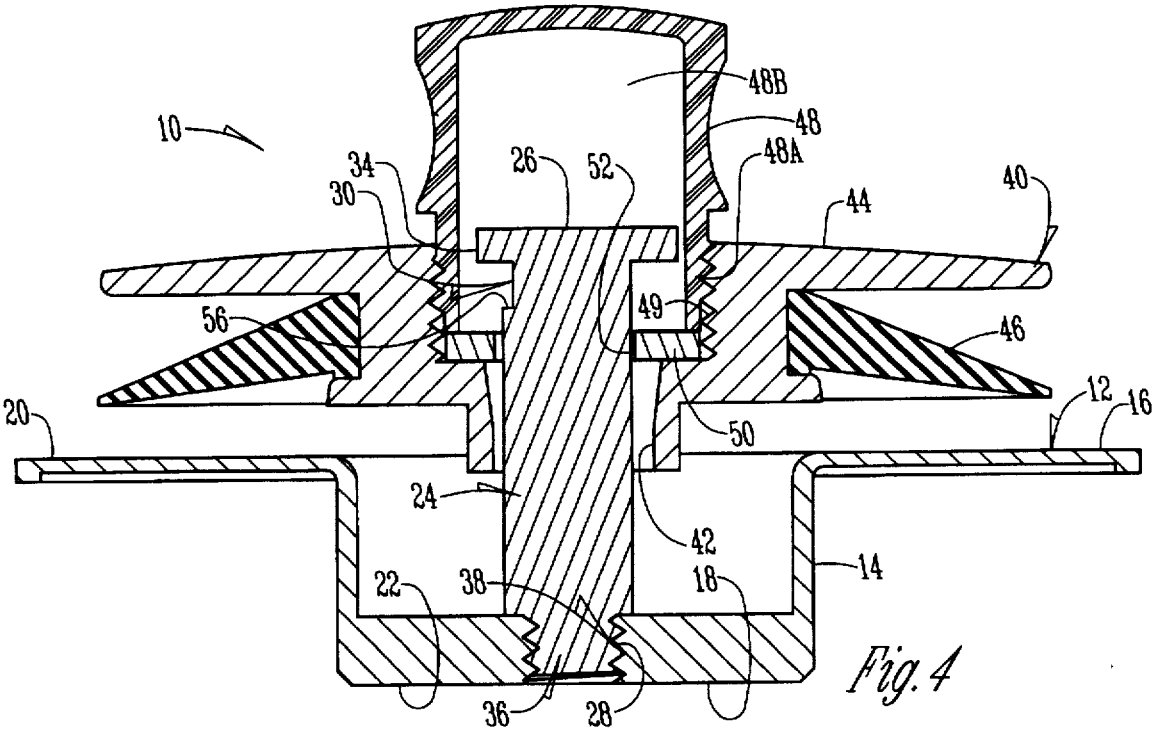
FIG. 4 is a sectional view similar to that of FIG. 3 but shows the closure member in a position between its maximum raised and lowered positions.
Figure 5:
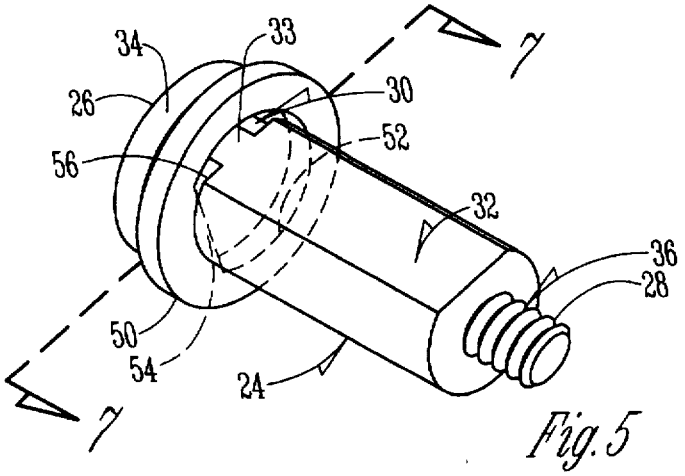
FIG. 5 is an enlarged scale perspective view of the post and retaining washer of this invention.

The components in FIGS. 1 and 2 are assembled as best shown in FIGS. 3 and 4. In FIG. 3, the closure member has been slidably raised on post 24. While in the slidable mode, the washer and post are in the position shown in FIGS. 4 and 6. When the closure member is raised sufficiently so that the washer 50 is in the same plane as the annular groove 30, the closure member is rotated in the groove from the position shown in FIG. 8 to the position shown in FIG. 5. This causes the flat segment 54 to depart from its engagement with the flat planar surface 33 in the annular groove, and causes the flat segment to then rest on the bottom surface 56 of groove 30 (FIGS. 3, 5 and 6). This engagement between the flat segment 54 of washer 50 with the bottom surface 56 of groove 30 holds the closure member in the elevated position shown in FIG. 3.

To release the closure member for downward movement to seal on the top of the drain insert 14, the closure member 40 is merely rotated (by grasping knob 48) so that the flat segment 54 becomes aligned with the planar surface 33, whereupon the closure member can slide down the post 24 in the position shown in FIGS. 4 and 6. The hollow knob 48 has an interior space of sufficient vertical height to receive the upper end of post 24.

Therefore, it is seen that this invention will achieve at least all of its stated objectives.

What is claimed is:

1. A waste water valve for use in the bottom of a liquid receptacle, comprising, a base member having a cylindrical drain insert with open upper and lower ends, a horizontal flange extending around the upper end of said drain insert, a support member extending across said drain insert adjacent said lower end, a vertical post having upper and lower ends, with said lower end being secured to the center of said support member, and with said upper end terminating above the level of the horizontal flange on said drain insert, a closure member having a central portion with a vertical central bore therein rotatably and slidably receiving said vertical post, a horizontal flange extending from said closure member and being positioned above and parallel to the horizontal flange on said drain insert, a cylindrical seal element secured to said closure member below and adjacent to the horizontal flange on said closure member and adapted to move into sealing contact with the horizontal flange of said drain insert when said closure member moves downwardly to its maximum lowest position on said post, a hollow knob removably secured to said closure member and extending upwardly therefrom to receive the upper end of said post, a circular annular groove adjacent the upper end of said post, a planar vertical surface on said post intersecting said annular groove, a washer having a center bore loosely and rotatably mounted in said annular groove, the center bore of said washer being circular with a flat segment extending across one portion thereof so that said washer can slide on said post when said flat segment is aligned with said planar surface on said post, and wherein said washer while in said annular groove will hold said closure member in an elevated position on said post when said closure member and said washer are turned to a position where said flat segment is disaligned with said planar surface on said post.

2. The device of claim 1 wherein said post has an enlarged upper end portion that has a diameter greater than that of the center bore of said washer.

3. The device of claim 1 wherein said washer is held against vertical movement in the central bore of said closure member by said knob.

4. The device of claim 1 wherein said hollow knob has a vertical space therein sufficient to receive the upper end of said post when said closure member is in its lowest position on said post.

* * * * *